US007967464B2

(12) United States Patent
Ratmansky et al.

(10) Patent No.: US 7,967,464 B2
(45) Date of Patent: Jun. 28, 2011

(54) APPARATUS AND METHOD FOR DISPLAYING AN OBJECT HAVING RELIEF

(76) Inventors: Paul Phillip Ratmansky, Philadelphia, PA (US); Joel David Ratmansky, Philadelphia, PA (US)

( * ) Notice: Subject to any disclaimer, the term of this patent is extended or adjusted under 35 U.S.C. 154(b) by 350 days.

(21) Appl. No.: 12/120,737

(22) Filed: May 15, 2008

(65) Prior Publication Data

US 2008/0285261 A1 Nov. 20, 2008

Related U.S. Application Data

(60) Provisional application No. 60/930,784, filed on May 18, 2007.

(51) Int. Cl.
*F21V 21/08* (2006.01)

(52) U.S. Cl. ..... 362/154; 206/8; 362/104; 40/323; 40/541

(58) Field of Classification Search ..... 362/26, 362/29, 30, 103, 104, 200, 249.01, 249.02, 362/249.06, 249.16, 253, 619, 625, 800, 362/806; 40/27.5, 323, 364, 541–544, 587, 40/588; 206/8, 81, 82, 84
See application file for complete search history.

(56) References Cited

U.S. PATENT DOCUMENTS

| | | | | |
|---|---|---|---|---|
| 2,389,312 | A * | 11/1945 | Honza | 206/0.82 |
| 2,467,043 | A | 4/1949 | Kotler | |
| 2,553,257 | A * | 5/1951 | Honeyman | 453/50 |
| 2,569,212 | A | 9/1951 | Zagotti | |
| 2,704,211 | A | 3/1955 | Decipoli | |
| 3,481,652 | A | 12/1969 | Mazerolle | |
| 3,953,932 | A | 5/1976 | Graves | |
| 4,441,762 | A | 4/1984 | Segal | |
| 4,534,185 | A | 8/1985 | Berry | |
| 4,940,441 | A | 7/1990 | Novinsky | |
| 4,977,695 | A * | 12/1990 | Armbruster | 40/541 |
| 5,011,005 | A * | 4/1991 | Boyd et al. | 206/0.81 |
| 5,058,959 | A | 10/1991 | Miles | |
| 5,092,806 | A | 3/1992 | Brown | |
| 5,191,972 | A * | 3/1993 | Helzer et al. | 206/0.84 |
| 5,316,376 | A | 5/1994 | Defreitas | |
| 5,499,710 | A * | 3/1996 | Hoffman | 206/0.81 |
| 5,697,858 | A | 12/1997 | Lekavich | |
| 5,934,784 | A * | 8/1999 | Dion | 362/103 |
| 5,984,485 | A * | 11/1999 | Poli et al. | 362/26 |
| 6,190,026 | B1 * | 2/2001 | Moore | 362/487 |
| 6,202,835 | B1 * | 3/2001 | Morse | 206/0.84 |
| 6,217,468 | B1 | 4/2001 | Goodwin | |
| 6,248,034 | B1 | 6/2001 | Voloshen | |
| 6,309,027 | B1 | 10/2001 | Smith | |

(Continued)

FOREIGN PATENT DOCUMENTS

EP 458203 A2 11/1991

(Continued)

*Primary Examiner* — Hargobind S Sawhney
(74) *Attorney, Agent, or Firm* — Robert J. Yarbrough; Lipton, Weinberger & Husick

(57) ABSTRACT

The Invention is an apparatus for displaying a medallion in an item of memorabilia. The item of memorabilia defines a cavity. A holder is configured to be contained within the cavity and defines a medallion-receiving opening selectably receiving the medallion. The holder contains an LED lamp oriented generally parallel to the display surface of the medallion. The LED lamp causes the relief of the medallion to cast a shadow on the display surface of the medallion. The lustrous metal of the medallion reflects light from the relief to an observer.

18 Claims, 6 Drawing Sheets

U.S. PATENT DOCUMENTS

| | | | | |
|---|---|---|---|---|
| 6,685,338 | B1 * | 2/2004 | Lewis et al. | 362/234 |
| 6,973,747 | B2 * | 12/2005 | Ratmansky et al. | 40/327 |
| 7,175,324 | B2 * | 2/2007 | Kwon | 362/545 |
| 7,437,840 | B2 * | 10/2008 | Ratmansky et al. | 40/27.5 |
| 2001/0036877 | A1 | 11/2001 | Hartman | |
| 2002/0108280 | A1 * | 8/2002 | Fernandez | 40/323 |
| 2003/0033738 | A1 * | 2/2003 | Lii | 40/364 |
| 2003/0112619 | A1 * | 6/2003 | Ewers et al. | 362/27 |

FOREIGN PATENT DOCUMENTS

| | | | |
|---|---|---|---|
| FR | 2627972 | A1 * | 9/1989 |
| JP | 59120983 | A * | 7/1984 |

* cited by examiner

APPARATUS AND METHOD FOR DISPLAYING AN OBJECT HAVING RELIEF

I. RELATED APPLICATIONS

This application claims priority from provisional U.S. patent application No. 60/930,784 filed May 18, 2007 by the inventors named herein.

II. BACKGROUND OF THE INVENTION a. Field of the Invention

The invention is related to the display of objects having relief, such as minted coins or medallions. The object having relief may be inset for display into a holder comprising an item of memorabilia such as an ice hockey puck or a model of a tire. The inset object having relief may be illuminated to highlight the relief. Illumination may be provided by one or more miniature light emitting diodes (LEDs) mounted in close proximity to the surface of the minted medallion or coin.

b. Description of the Related Art

Objects having relief, such as a minted medallion, may be incorporated into a sports memorabilia apparatus, as is taught by U.S. Pat. No. 6,973,747 issued Dec. 13, 2005 to the inventors named herein and as taught in pending application Ser. No. 11/284,073 filed Nov. 18, 2005 by the inventors named herein. That patent and pending application are hereby incorporated by reference into this application.

III. BRIEF DESCRIPTION OF THE INVENTION

The Invention applies to an apparatus for illuminating a coin, medallion or other highly reflective object having relief when the coin, medallion or highly reflective object having relief is inset into an opening in an item of memorabilia. The item of memorabilia may be a hockey puck, a model of a tire, or any other item in which a collector of memorabilia may be interested. The present invention provides LED lamps mounted to the item of memorabilia and configured to illuminate the medallion from a shallow angle, highlighting the relief of the medallion and enhancing the value of the combination of the item of memorabilia and the medallion to the collector of memorabilia.

The inventors have discovered that minted medallions having highly reflective display surfaces are most effectively displayed when a light source located very near to the display surface of the medallion is directed across the display surface at a shallow angle. The angle should be sufficiently shallow that the relief minted into the coin or medallion will cast a visible shadow. The light source may be oriented to be parallel to the display surface of the minted coin or medallion. The combination of light reflecting from the relief appearing on the surface of the coin or medallion and shadows cast by the relief provide a striking visual effect.

The present Invention is particularly applicable to the display of a medallion composed of a lustrous metal and having a highly reflective surface featuring relief formed by minting technology. As used in this document and in the claims, the term 'medallion' means a coin or other object that has a lustrous display surface having relief. A medallion has a width that is large compared to the thickness of the medallion.

Since the amount of relief minted into coins and medallions is small, conventional incandescent or fluorescent lights are far too large to achieve the shallow angles and close proximity that are most effective for displaying the small amount of relief present. LED lamps may be only a few millimeters in diameter and have proven successful in practice in providing an adequately small light source to achieve the shallow angles required. LED lamps also are adequately bright to create the visible highlights and shadows that effectively display the relief of the medallion. The LED lamp preferably is supported so that the longitudinal axis of the lamp is either parallel to the display surface of the medallion or intersects a plane defined by the display surface of the medallion at a shallow angle.

Alternative means for illuminating the medallion are addressed by this application. In each alternative, a medallion is inset into an opening in an item of memorabilia and one or LED lamps are mounted to the item of memorabilia in such a configuration that light from the lamps will strike the medallion at a shallow angle, creating highlights and shadows of the relief minted into the lustrous medallion. In each alternative, a power supply and switch are mounted within the item of memorabilia. The power supply may be a battery. Alternatively, the power supply may be an electrical cord leading from the puck to a wall outlet.

As a first alternative, a separate holder for the LED lamp and the medallion is provided. The holder is inset into a cavity defined by the item of memorabilia. The holder defines a medallion-receiving opening and supports one or more LED lamps. The holder also may define a utility space to accommodate the power supply and the pressure switch. The holder supports the LED lamp in close proximity to the display surface of the medallion when the medallion is in engagement with the medallion-engaging opening. The holder may support the medallion either flush with the surface of the item of memorabilia or inset below the surface of the item of memorabilia. The separate holder, which may be manufactured using injection molding or other molding technology, offers the advantage of avoiding complex machining or forming of the item of memorabilia.

As a second alternative, the separate holder may be dispensed with and the medallion-receiving opening formed directly in the item of memorabilia, as by machining a medallion-receiving opening in a hockey puck. The display surface of the medallion may be flush with the surface of the item of memorabilia when the medallion is retained by the medallion-engaging opening. Alternatively, the medallion may be inset so that the medallion display surface is inset below the surface of the item of memorabilia.

For the second alternative, the location of the LED lamps depends upon the location of the medallion. For example, where the medallion inset flush with the surface, then LED lamps are mounted above the surface of the hockey puck. Light from the LED lamps is directed across the surface of the medallion at a shallow angle, highlighting the relief of the medallion. As a second example, LED lamps are mounted flush with the surface of the hockey puck, as in slots cut or molded into the surface of the puck. The medallion is inset into the surface of the hockey puck to a depth slightly below that of the LED lamps. Light from the LED lamps strikes the medallion at a shallow angle, illuminating the medallion and highlighting the relief. As a third example, LED lamps are mounted below the surface of the item of memorabilia, as in cavities machined or molded into the item of memorabilia. The medallion is inset into the surface of the item of memorabilia to a depth slightly below that of the LED lamps. Light from the LED lamps strikes the medallion at a shallow angle, highlighting the relief minted into the medallion.

When the terms 'hockey puck' or 'model of a tire' are used herein to describe the object into which a medallion in inset, the terms should be considered to include any item of memorabilia.

IV. DESCRIPTION OF THE FIGURES

V. DESCRIPTION OF AN EMBODIMENT

U.S. Pat. No. 6,973,747 and Pending application Ser. No. 11/284,073 teach insetting of a minted medallion 2 into a hockey puck or a model of a tire to create an item of memorabilia 4 that is desirable to a collector. The present Invention relates to the illumination of a medallion 2 when the medallion 2 is inserted into an item of memorabilia 4, such as a hockey puck or model of a tire.

Figure 1:
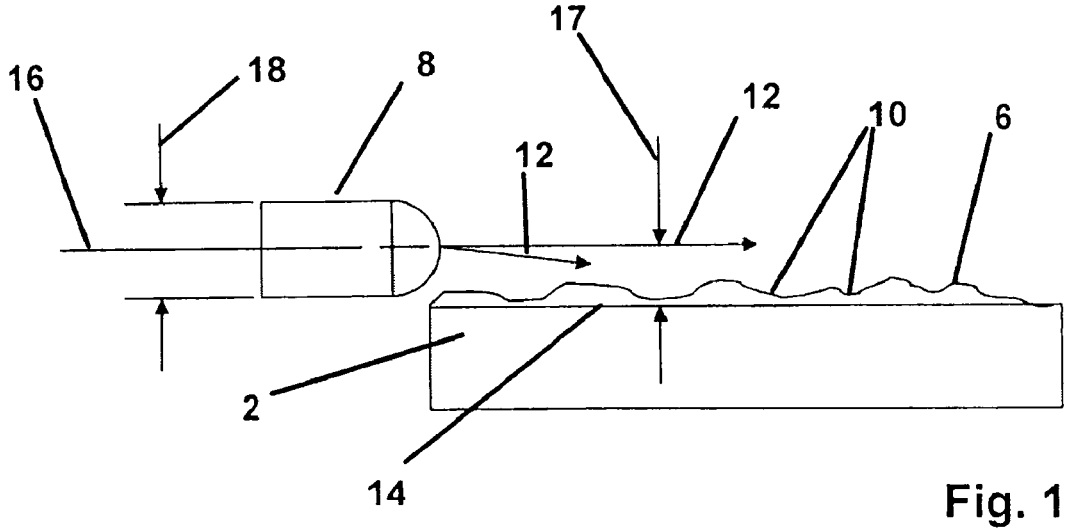
FIG. 1 is a schematic diagram of the illumination by a LED lamp of the relief minted into a medallion.

As shown by FIG. 1, relief 6 may be minted into a medallion 2, for example, the image of George Washington appearing on a U.S. quarter. For medallions 2 composed of a lustrous metal, the relief 6 may not be readily visible under diffuse light. An adequately small, adequately bright, and adequately directional lamp located adequately close to the surface 12 of the medallion 2 so as to create visible shadows and highlights 10 caused by the relief 6 dramatically enhances the visual effect of the relief 6 of the medallion 2. The improved display of the medallion 2 increases the value of the medallion 2 to a collector of memorabilia 4. An LED lamp 8 has proven to be adequately small, bright and directional in practice for this application.

FIG. 1 illustrates the shallow angle of incidence of light 12 required for illumination of the relief 6 minted into the medallion 2. The angle that incident light 12 strikes the medallion 2 should be adequately shallow to create highlights and to cast visible shadows 10 caused by the relief 6 minted into the medallion 2. An adequately shallow angle of illumination is best achieved using LED lamps 8 mounted in close proximity to and immediately above the display surface 14 of the medallion 2.

As shown by FIG. 1, effective illumination of the display surface 14 is best achieved when the longitudinal axis 16 of the LED lamp 8 is oriented generally parallel to the display surface 14 of the medallion 2, with the longitudinal axis located at a distance 17 equal to or less than one LED lamp diameter 18 from the display surface 14. The LED lamp 8 may be oriented with respect to display surface so that the longitudinal axis 16 of LED lamp 8 intersects with a plane defined by display surface 14 at an acute angle, to reduce glare and escape of extraneous light 12.

Figure 2:
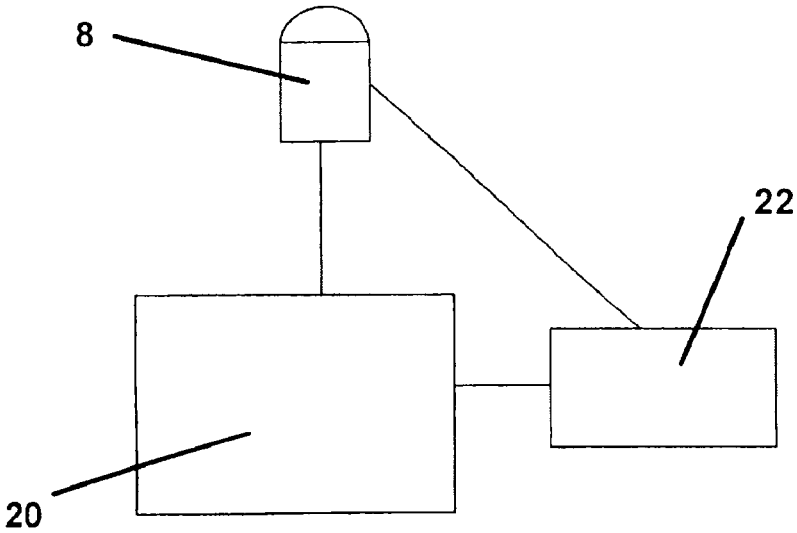
FIG. 2 is a schematic electrical diagram of the Invention.

FIG. 2 illustrates the electrical components of the Invention. A power supply 20 provides electrical power. The power supply 20 may be a battery or may be a transformer powered by a wall outlet. A switch 22 allows selectable illumination of the LED lamps 8. Any number of LED lamps 8 is contemplated by the Invention for illumination of medallion 2.

Figure 3:
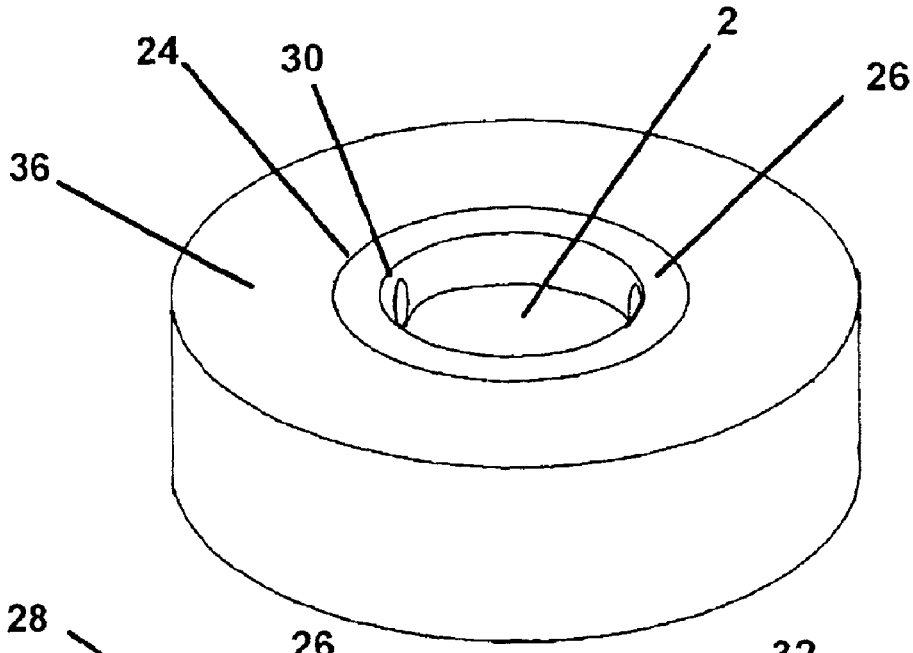
FIG. 3 is a perspective view of a first embodiment utilizing a holder.
Figure 4:
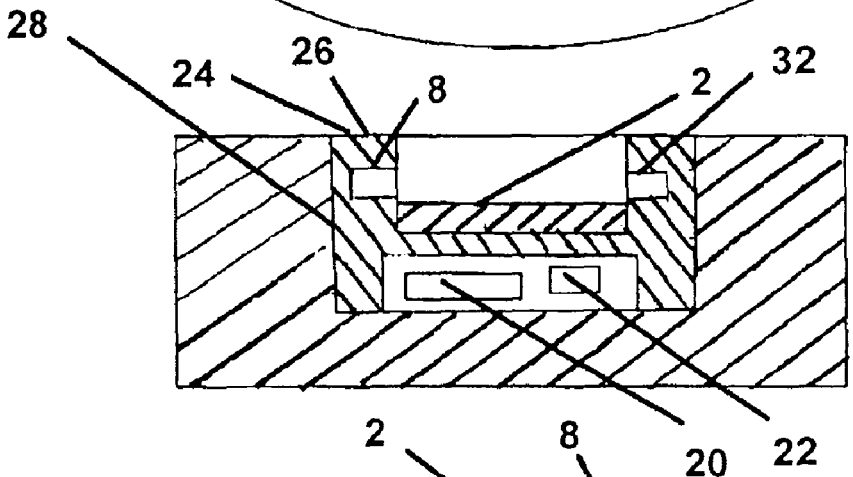
FIG. 4 is a cross section of the first embodiment utilizing the holder.
Figure 5:
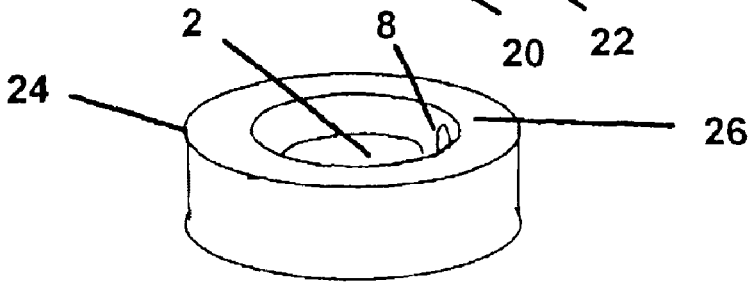
FIG. 5 is a perspective view of the holder.

FIGS. 3-5 illustrate the apparatus for mounting the medallion 2 and the LED lamps 8 in the item of memorabilia 4, in this instance a hockey puck. A holder 24 defines a holder surface 26. The medallion 2, the LED lamps 8, power supply 20 and switch 22 all are housed within the holder 24. The holder 24 mates with a cavity 28 formed in the item of memorabilia 4. The holder 24 defines a medallion-engaging opening 30. The medallion-engaging opening 30 selectably receives and retains the medallion 2 for display, preferably by interference between the side wall of the medallion-engaging opening and the outside edge of the medallion, shown by FIG. 4. The holder 24 defines a lamp cavity 32 to receive the LED lamp 8 and to orient the lamp 8 with respect to the medallion 4. The holder 24 also defines a utility space containing the power supply 20 and the pressure switch 22.

The separate holder 24 of FIGS. 3-5 offers that advantage that all openings and fixtures to retain the medallion 2, LED lamps 8, power supply 20 and switch 22 are formed in the holder 24, eliminating the requirement for complex machining or forming of the item of memorabilia 4. The complex shapes of the holder 24 may be formed by injection molding of a polymer or by any suitable technology known in the art. The removable holder 24 also offers the advantage that changes in the functional design may be accomplished with relative ease and at relatively low cost by changing the design of the holder 24 and without changing the design of the item of memorabilia 4 or of the medallion 2.

Figure 6:
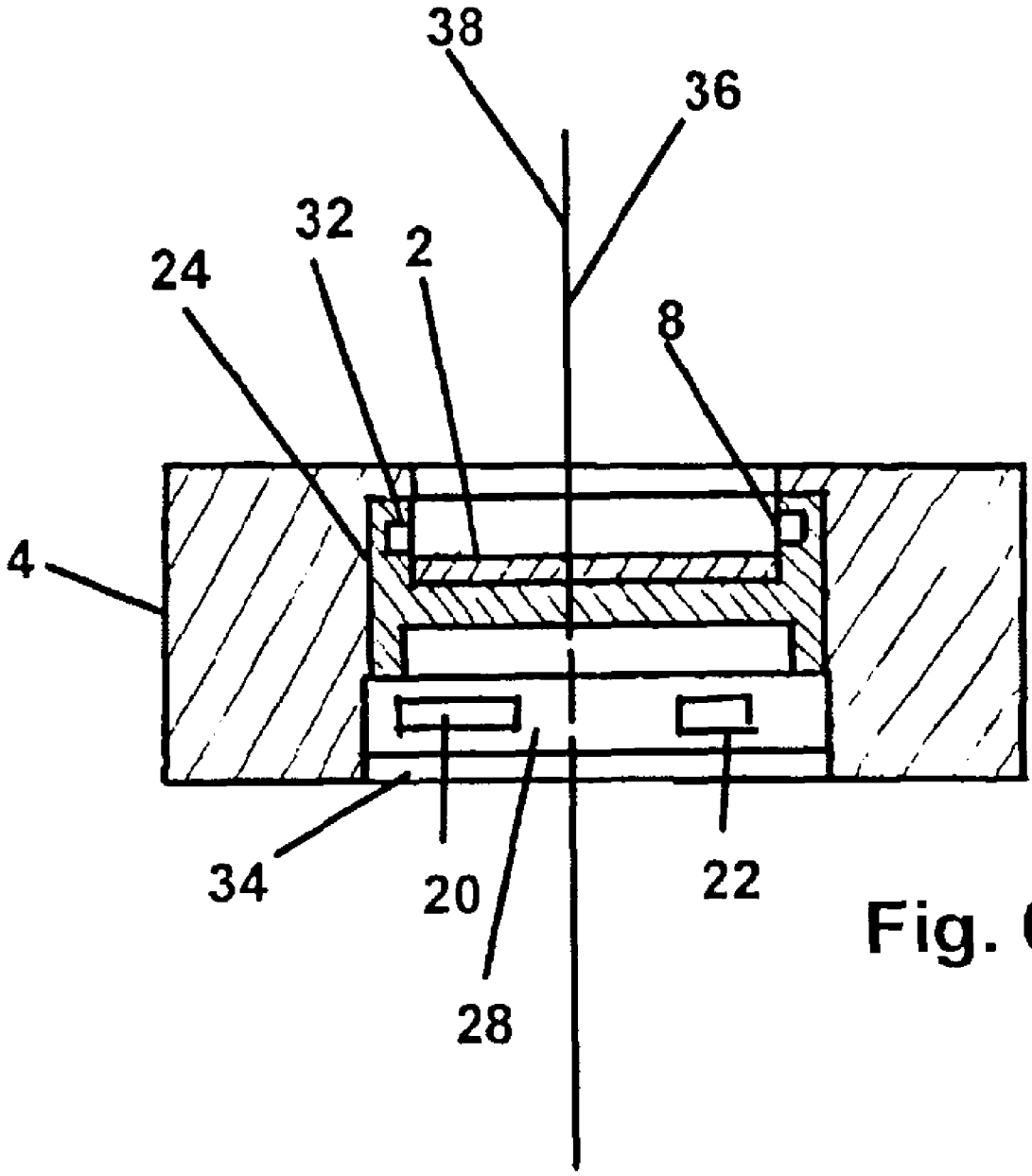
FIG. 6 is a cross section of a second embodiment utilizing the holder.

A second embodiment utilizing a separate holder 24 is illustrated by FIG. 6. In the embodiment of FIG. 6, cavity 28 extends through the item of memorabilia 4 from the front side to the back side of the item of memorabilia 4. A utility opening cover 34 covers the opening to the cavity 28 on the back side of the item of memorabilia 4. Pressure switch 22 is operably connected to utility opening cover 34 so that depressing utility opening cover 34 activates switch 22, selectably activating and deactivating lamp 8.

Figure 7:
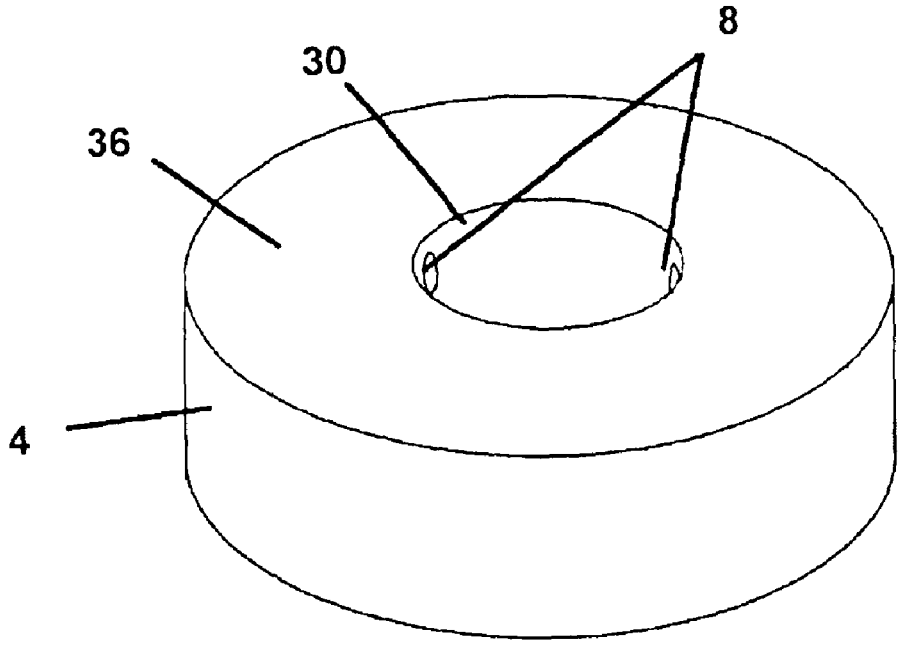
FIG. 7 is a perspective view of a third embodiment not using the holder.
Figure 8:
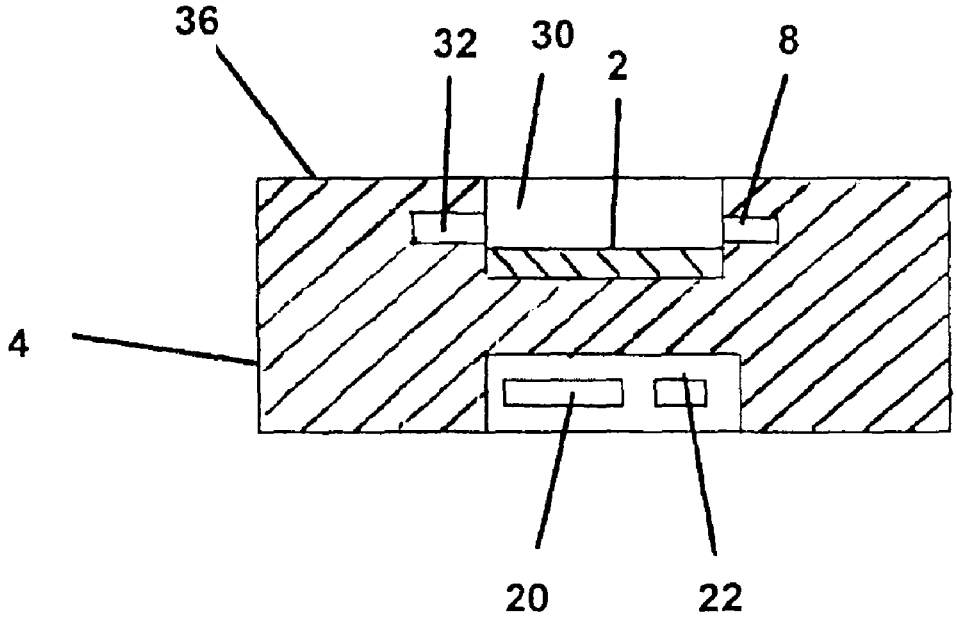
FIG. 8 is a cross section of the third embodiment.

FIGS. 7 and 8 illustrate an embodiment that does not utilize a separate holder 24. In the embodiment of FIGS. 7 and 8, the medallion-engaging opening 30 is formed directly in the item of memorabilia 4. Medallion 2 is selectably contained within the medallion-engaging opening 30, as for the holder 24 embodiments discussed above. LED lamps 8 are contained within lamp cavities 32 formed directly in the item of memorabilia 4. Power supply 20 and pressure switch 22 are housed within a utility opening on a back side of the item of memorabilia 4. The embodiment illustrated by FIGS. 7 and 8 otherwise functions as does the embodiment of FIGS. 3-5.

Figure 9:
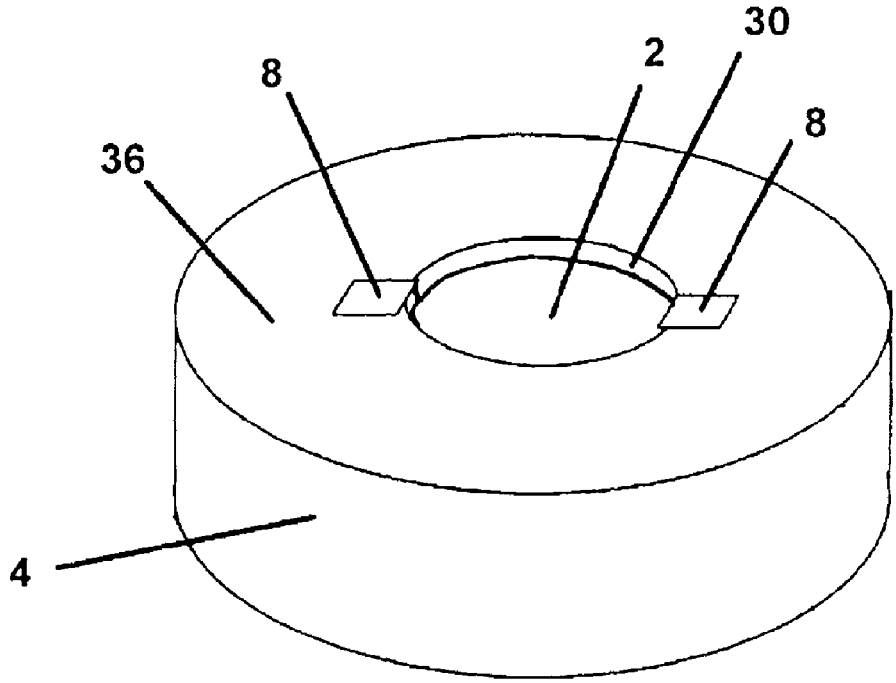
FIG. 9 is a perspective view of a fourth embodiment not utilizing the holder.
Figure 10:
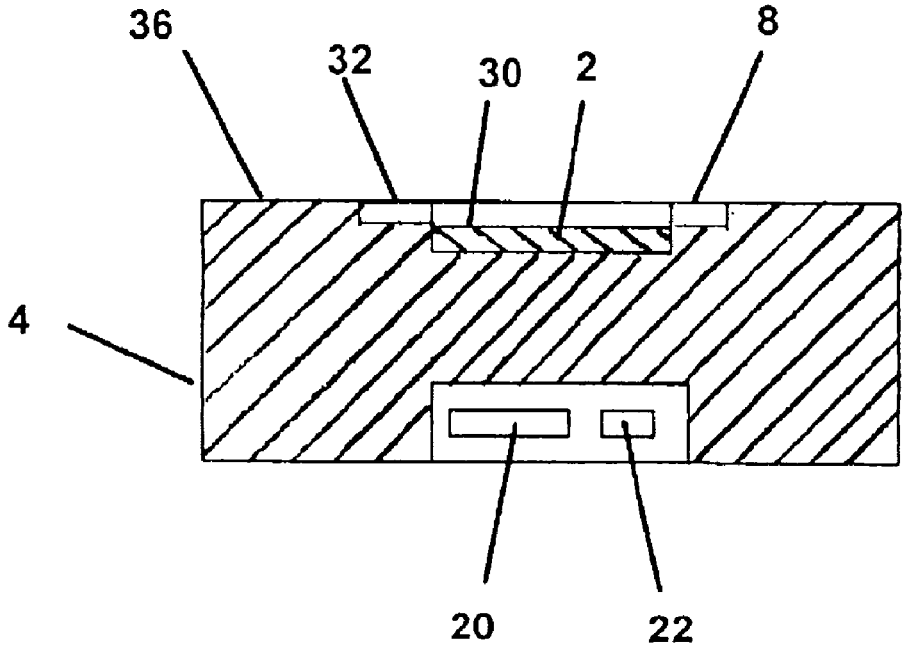
FIG. 10 is a cross section view of a fourth embodiment.

FIGS. 9 and 10 illustrate a variation of the embodiment discussed above with respect to FIGS. 7 and 8. LED lamps 8 and lamp cavities 32 are formed in the item of memorabilia 4 adjacent to front surface 36 of the item of memorabilia 4, allowing medallion-engaging opening 30 to be relatively shallow.

In each of the embodiments, the display surface 14 of medallion 2 is recessed with respect to the immediately surrounding surface, either the holder surface 26 for embodiments utilizing a holder 24, or the front surface 36 of the memorabilia for embodiments that do not utilize a holder 24.

Figure 11:
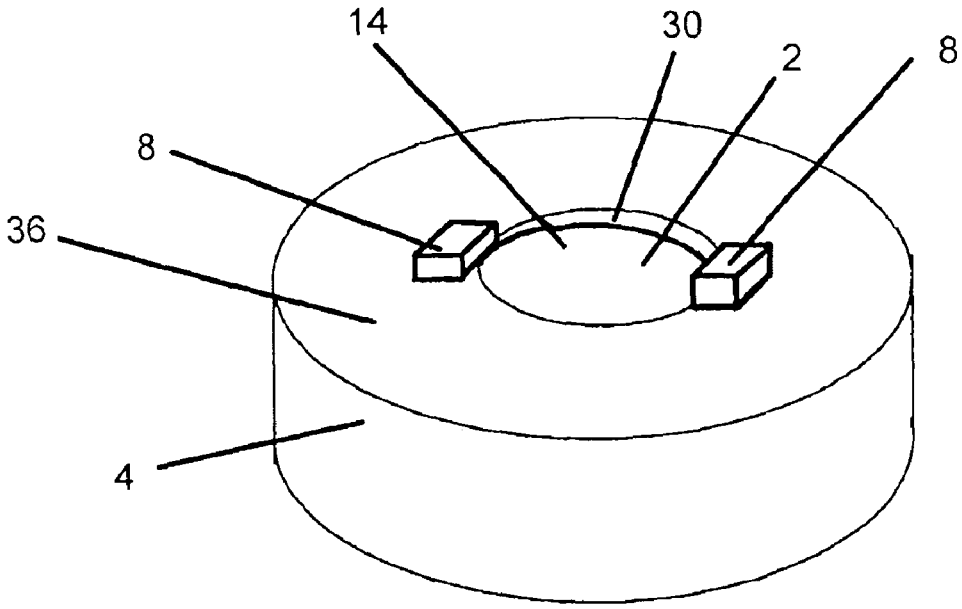
FIG. 11 is a perspective view of the embodiment of FIG. 9 with the LED lamps mounted above the front surface of the item of memorabilia.
Figure 12:
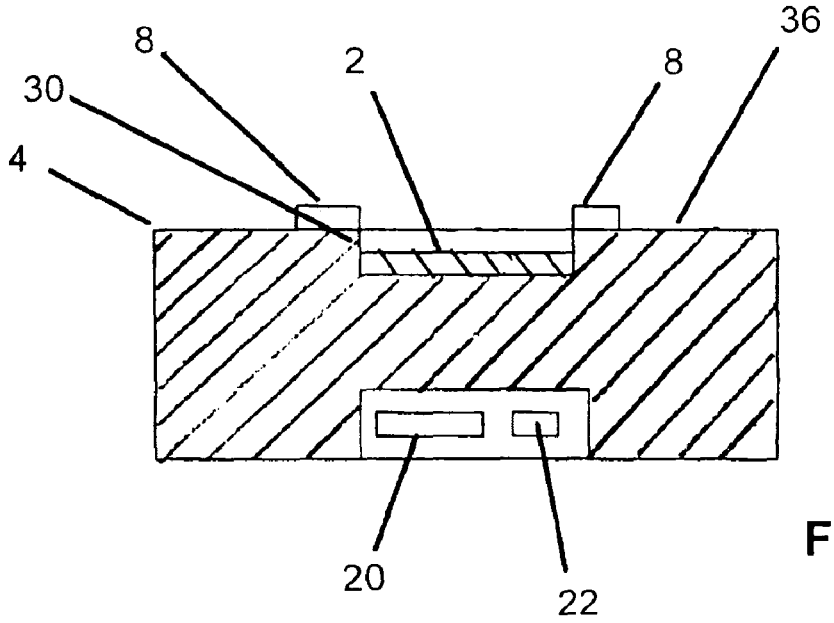
FIG. 12 is a cross sectional view of the apparatus of FIG. 11.

FIGS. 11 and 12 illustrate an embodiment in which LED lamps 8 are mounted above the front surface 36 of item of memorabilia 4 while the medallion 2 is inset with respect to the front surface 36 of the item of memorabilia 4. The relationship between the display surface 14 of medallion 2 and the LED lamps 8 is as described above for FIG. 1. The LED lamps 8 are supported by the item of memorabilia 4, powered by power supply 20 and activated by switch 22.

In describing the above embodiments of the invention, specific terminology was selected for the sake of clarity. However, the invention is not intended to be limited to the specific terms so selected, and it is to be understood that each specific term includes all technical equivalents that operate in a similar manner to accomplish a similar purpose.

We claim:

1. An apparatus for displaying a medallion in an item of memorabilia, the apparatus comprising:

a. A holder for the medallion, the item of memorabilia defining a cavity, said holder being configured to engage the item of memorabilia and to be contained within said cavity, said holder defining a holder surface, said holder surface defining a medallion-engaging opening, said opening being configured to selectably receive the medallion, said holder and the medallion defining a releasable engagement between said holder and the medallion when the medallion is received by said opening, the medallion defining a pair of opposing medallion display surfaces, each of said medallion display surface defining a relief, said relief being equivalent to said relief of a minted coin, a selected one of said opposing pair of display surfaces being visible and the other of said opposing pair of display surfaces not being visible when said medallion and said holder are in said engagement and said holder is contained within said cavity, the item of memorabilia having a memorabilia surface, said memorabilia surface defining said memorabilia cavity;

b. A source of a light, said source of said light being configured to direct said light at an angle with respect to said selected one of said opposing pair of display surfaces when said medallion is in said engagement with said holder, said source of said light being located at a distance from said display surface when said medallion is in said engagement with said holder, said angle and said distance being selected so that said relief of the medallion casts a shadow upon said display surface when the medallion is in said engagement with said holder and said light is directed at said angle, said source of said light being supported by said holder, said selected one of said opposing pair of display surfaces being a light incident surface of said light coming from said source of said light.

2. The apparatus of claim 1 wherein the medallion has opposing sides that define a medallion width generally parallel to said display surface and that define a medallion thickness generally normal to said display surface, said medallion width being large compared to said medallion thickness, said medallion being minted of a lustrous metal, the medallion defining an outside edge oriented substantially normal to said display surface, said opposing sides defining said pair of opposing medallion display surfaces.

3. The apparatus of claim 2 wherein said source of said light is a lamp and said lamp is a light-emitting diode, said light-emitting diode defining a lamp longitudinal axis, said light-emitting diode being configured to direct said light along said lamp longitudinal axis, said lamp longitudinal axis and said display surface in combination defining said angle.

4. The apparatus of claim 3 wherein said lamp longitudinal axis is generally parallel to said display surface when said medallion and said holder are in said engagement.

5. An apparatus for displaying a medallion in an item of memorabilia, the apparatus comprising:

a. A holder for the medallion, the item of memorabilia defining a cavity, said holder being configured to engage the item of memorabilia and to be contained within said cavity, said holder defining a holder surface, said holder surface defining a medallion-engaging opening, said opening being configured to selectably receive the medallion, said holder and the medallion defining a releasable engagement between said holder and the medallion when the medallion is received by said opening, the medallion defining a medallion display surface defining a relief, the item of memorabilia having a memorabilia surface, said memorabilia surface defining said memorabilia cavity;

b. A source of a light, said source of said light being configured to direct said light at an angle with respect to said display surface when said medallion is in said engagement with said holder, said source of said light being located at a distance from said display surface when said medallion is in said engagement with said holder, said angle and said distance being selected so that said relief of the medallion casts a shadow upon said display surface when the medallion is in said engagement with said holder and said light is directed at said angle, said source of said light being supported by said holder, wherein the medallion has opposing sides that define a medallion width generally parallel to said display surface and that define a medallion thickness generally normal to said display surface, said medallion width being large compared to said medallion thickness, said medallion being minted of a lustrous metal, the medallion defining an outside edge oriented substantially normal to said display surface, wherein said source of said light is a lamp and said lamp is a light-emitting diode, said light-emitting diode defining a lamp longitudinal axis, said light-emitting diode being configured to direct said light along said lamp longitudinal axis, said lamp longitudinal axis and said display surface in combination defining said angle, said lamp longitudinal axis is generally parallel to said display surface when said medallion and said holder are in said engagement, wherein said medallion-engaging opening defines an opening side wall and said opening side wall defines a lamp cavity, said lamp being positioned within said lamp cavity, said lamp cavity having a location, said lamp cavity location defining said distance between said lamp and said display surface when the medallion is in said engagement with said holder.

6. The apparatus of claim 5 wherein said lamp has a lamp diameter normal to said lamp longitudinal axis, said distance between said lamp and said display surface comprising: said lamp longitudinal axis being separated by one lamp diameter or less from said display surface when said medallion is in said engagement with said opening.

7. The apparatus of claim 1, said engagement between said holder and the medallion comprising: said opening side wall selectably engaging said medallion edge, said opening side wall being generally normal to said medallion display surface when said medallion and said holder are in said engagement.

8. The apparatus of claim 7 wherein said holder is generally in the shape of a cylindrical solid.

9. The apparatus of claim 8 wherein said holder defines a holder axis, said medallion-engaging opening defining an opening axis, said holder axis and said opening axis being substantially coextensive.

10. The apparatus of claim 1, the apparatus further comprising:

a. A power supply operably connected to said light-emitting diode;

b. A switch operably connected to said power supply and configured to selectably illuminate said light-emitting diode.

11. The apparatus of claim 10 wherein the item of memorabilia has a memorabilia rear side opposite said memorabilia surface, said memorabilia rear side defining a utility opening, said power supply comprising: a battery located within said utility opening.

12. An apparatus for displaying a medallion in an item of memorabilia, the apparatus comprising:

a. A holder for the medallion, the item of memorabilia defining a cavity, said holder being configured to engage the item of memorabilia and to be contained within said cavity, said holder defining a holder surface, said holder surface defining a medallion-engaging opening, said opening being configured to selectably receive the medallion, said holder and the medallion defining a releasable engagement between said holder and the medallion when the medallion is received by said opening, the medallion defining a medallion display surface defining a relief, the item of memorabilia having a memorabilia surface, said memorabilia surface defining said memorabilia cavity;

b. A source of a light, said source of said light being configured to direct said light at an angle with respect to said display surface when said medallion is in said engagement with said holder, said source of said light being located at a distance from said display surface when said medallion is in said engagement with said holder, said angle and said distance being selected so that said relief of the medallion casts a shadow upon said display surface when the medallion is in said engagement with said holder and said light is directed at said angle, said source of said light being supported by said holder;

c. A power supply operably connected to said light-emitting diode;

d. A switch operably connected to said power supply and configured to selectable illuminate said light-emitting diode, wherein the item of memorabilia has a memorabilia rear side opposite said memorabilia surface, said memorabilia rear side defining a utility opening, said power supply comprising: a battery located within said utility opening, and wherein said switch comprises: a pressure switch and a utility opening cover, said utility opening cover being configured to cover substantially said utility opening, said pressure switch being operably connected to said utility opening cover such that depression of said utility opening cover activates said pressure switch.

13. The apparatus of claim 12 wherein the item of memorabilia is a hockey puck or a model of a tire.

14. An apparatus for displaying a medallion in an item of memorabilia, the apparatus comprising:

a. the item of memorabilia defining a memorabilia surface, the medallion defining a pair of opposing medallion display surfaces, each of said medallion display surfaces having a relief, said relief being equivalent to said relief of a minted coin, the medallion having opposing sides that define a medallion width generally parallel to said display surface and that define a medallion thickness generally normal to said display surface, said medallion width being large compared to said medallion thickness, said medallion being composed of a lustrous metal, the medallion defining an outside edge oriented substantially normal to said display surface, said memorabilia surface defining a medallion-engaging opening, said medallion-engaging opening being configured to selectably receive the medallion, the item of memorabilia and said outside edge of said medallion defining a releasable engagement between the item of memorabilia and the medallion when the medallion is received by said medallion-receiving opening, the medallion being reversible so that a selected one of said pair of display surfaces is visible when said medallion and said medallion-receiving opening are in said engagement;

b. A source of a light, said source of said light being configured to direct said light at an angle with respect to said display surface when said medallion is in said engagement between said medallion and said medallion-receiving opening, said source of said light being located at a distance from said display surface when said medallion is in said engagement, said angle and said distance being selected so that said relief of the medallion casts a shadow upon said display surface when the medallion is in said engagement with said medallion-receiving opening and said light is directed at said angle, said source of said light being supported by said item of memorabilia, said selected medallion display surface being a light incident surface of said light coming from said source of said light.

15. The apparatus of claim 14 wherein said source of said light is a light-emitting diode, said light-emitting diode defining a longitudinal axis, said light-emitting diode being configured to direct said light generally along said longitudinal axis, said longitudinal axis being generally parallel to said display surface when said outside edge of the medallion and the item of memorabilia are in said engagement.

16. The apparatus of claim 15 wherein said medallion-engaging opening defines an opening side wall and said opening side wall defines a lamp cavity, said lamp being positioned within said lamp cavity, said lamp cavity having a location, said lamp cavity location defining said distance between said lamp and said display surface when the medallion is in said engagement with the item of memorabilia.

17. The apparatus of claim 16 wherein said light-emitting diode has a lamp diameter normal to said longitudinal axis, said distance between said lamp and said display surface comprising: said longitudinal axis being separated by one lamp diameter or less from said display surface when said medallion is in said engagement with said opening.

18. The apparatus of claim 17, said engagement between the item of memorabilia and the medallion comprising: said opening side wall selectably engaging said medallion edge, said opening side wall being generally normal to said medallion display surface when said medallion and the item of memorabilia are in said engagement, the item of memorabilia being generally in the shape of a cylindrical solid.

* * * * *